United States Patent [19]

Blodgett

[11] 4,295,230

[45] Oct. 20, 1981

[54] CHILDREN'S SLEEPING GARMENTS

[76] Inventor: Camille C. Blodgett, P.O. Box 202, West Stockbridge, Mass. 01266

[21] Appl. No.: 139,871

[22] Filed: Apr. 14, 1980

[51] Int. Cl.[3] ..... A41D 11/00

[52] U.S. Cl. ..... 2/69.5; 2/275

[58] Field of Search ..... 2/69.5, 69, 83, 275, 2/114

[56] References Cited

U.S. PATENT DOCUMENTS

| | | | |
|---|---|---|---|
| 1,332,301 | 3/1920 | Moore | 2/69 |
| 1,502,608 | 7/1924 | Young | 2/69.5 |
| 1,507,707 | 9/1924 | Morganstern | 2/275 X |
| 1,653,815 | 12/1927 | Millar | 2/69.5 X |
| 1,952,465 | 3/1934 | Rycroft | 2/69.5 |
| 2,307,266 | 1/1943 | Hansen | 2/114 |
| 2,399,782 | 5/1946 | Asher | 2/69.5 |
| 2,497,167 | 2/1950 | Guyol | 2/69.5 |
| 2,743,451 | 5/1956 | Meyers | 2/69.5 |

*Primary Examiner*—H. Hampton Hunter

*Attorney, Agent, or Firm*—Maurice R. Boiteau

[57] ABSTRACT

There is disclosed in the present application a sleeping garment for a child in the form of a bag which is closed at the bottom and provided with releasably fastened shoulder straps at the top. When the shoulder straps are unbuttoned, the child may be easily inserted into the garment from the top without requiring that its body be strained or twisted to permit insertion into the garment.

2 Claims, 4 Drawing Figures

CHILDREN'S SLEEPING GARMENTS

The present invention relates generally to improvements in children's sleeping garments and more particularly to such garments in the form of sleeping bags.

One of the difficulties frequently encountered in the rearing of babies is the problem of keeping them warm while they are sleeping without at the same time unduly restraining their movement both while they are asleep and when they awake. An expedient which has not been entirely satisfactory in solving the problems is the use of conventional children's sleeping bags so constructed that they perform the function of keeping the child warm but at a cost of considerable strain on the child in being inserted into and withdrawn from the garment. In addition, such conventional sleeping bags generally unduly restrain the child wearer's movement while he is awake and thus prevent him from engaging in playful activity for his own amusement.

A general object of the present invention is accordingly to enhance the safety, warmth and comfort of children while asleep or otherwise confined in cribs or play pens.

Another object is to improve the convenience of children's sleeping bags by facilitating the insertion and removal of children from them.

A further object is to improve the mobility of a child's upper torso while in a sleeping bag but without sacrificing inherent advantages of conventional sleeping bag warmth.

In the achievement of the foregoing objects, a feature of the invention relates to a novel sleeping bag construction including a pair of shoulder straps which are releasably connectible to retain the child in the bag, but which when disconnected, present an open top into which the child may be easily inserted without twisting or straining. The upper end of the bag including the straps are so shaped that the child wearer is retained in the garment but is free to move his shoulders, arms and hands to engage in safe activities while being kept warm and safe.

The foregoing objects, features and numerous advantages to be derived from the present invention will be more fully appreciated from the following detailed description of an illustrative embodiment taken in connection with the accompanying drawings in which.

Figure 4:
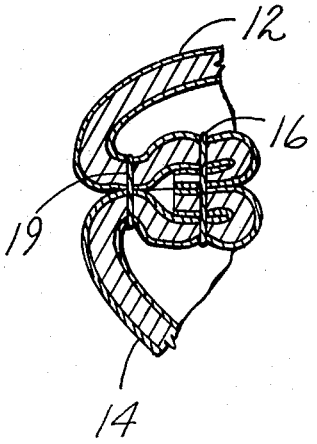
FIG. 4 is a view in cross section taken along the line IV—IV of FIG. 1, showing details of construction.

Turning now to the drawings, there is shown, a sleeping bag according to the invention, indicated generally at 10 and including front and rear panels 12 and 14 respectively. The panels 12 and 14 are connected by a seam 16 which extends continuously from one arm opening 18 to the other, passing, as seen in FIG. 4, through four thicknesses of material, the margin of each panel being folded outwardly to present a finished inside fold surface which may come into contact with the child wearer's skin. It will be readily appreciated that the front and rear panels are positioned inside out for inserting the seam 16 and that after the seam is inserted, the garment is turned right side out. At the same time that the seam 16 is being inserted a second seam 19 may also be inserted parallel to the seam 16 to provide greater strength and also to enclose the raw edges of the panels. Before inserting the seam 16 uniting the two panels, the upper portions of the panels defining the arm and neck openings are advantageously bound, typically with a form of binding tape. The rear panel is contoured to include a pair of shoulder straps 20 at its upper end, each of the straps bearing a button 22 at its distal end, to be received in a buttonhole 24 formed in an upwardly directed extension 26 of the front panel 12.

Figure 1:
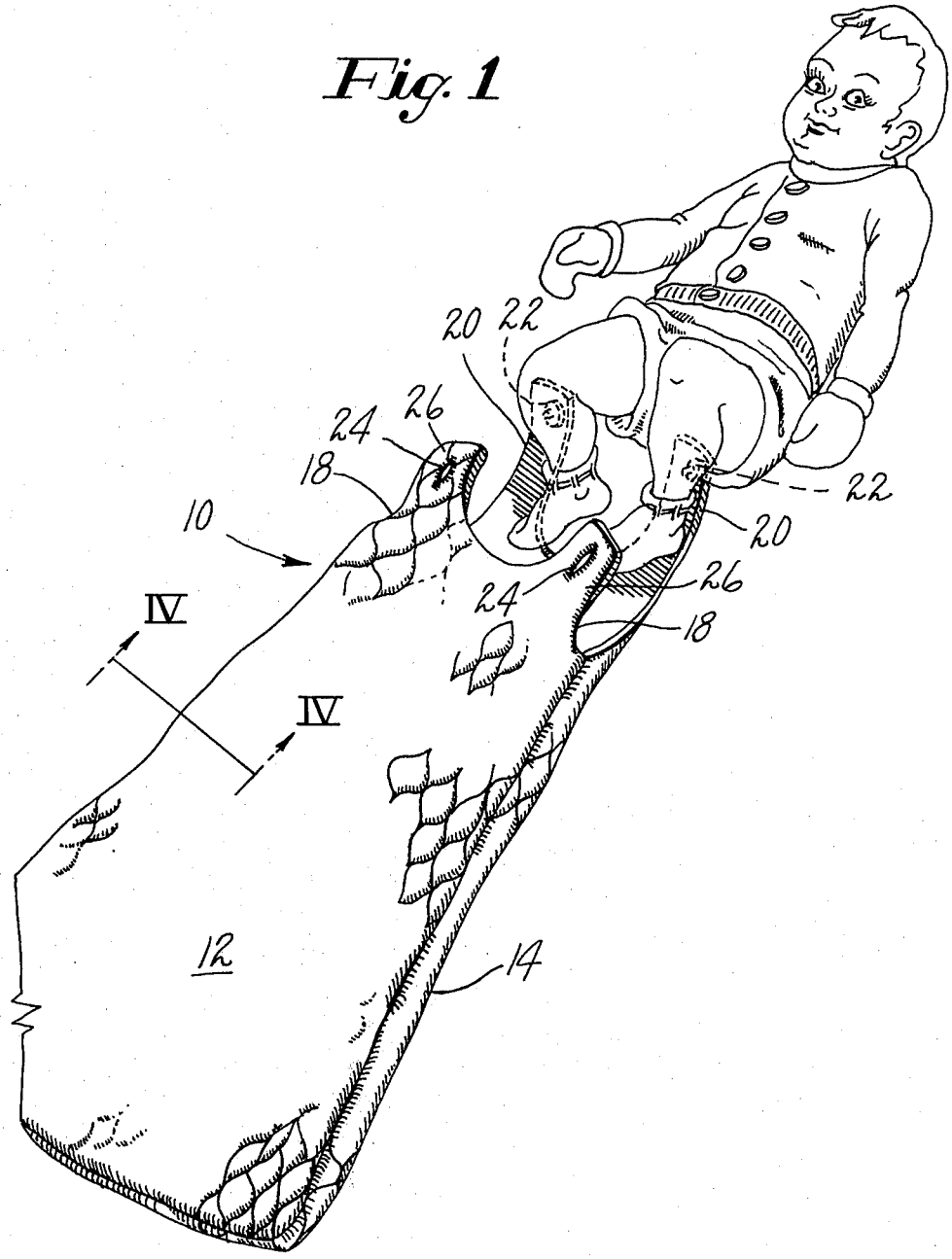
FIG. 1 is a view in perspective showing a sleeping bag according to the present invention with a child about to be inserted into it.
Figure 2:
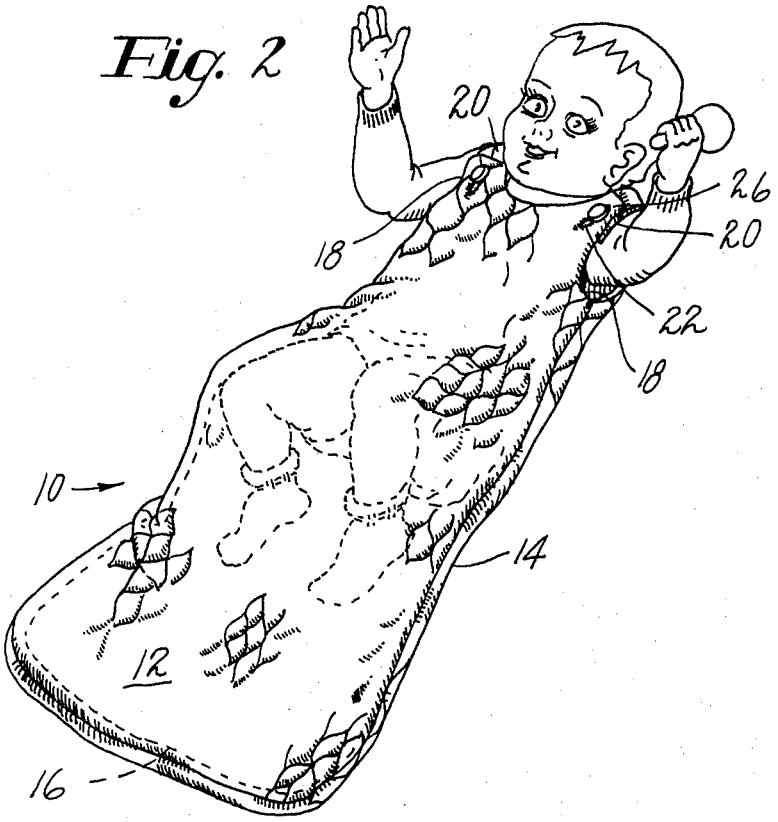
FIG. 2 is a view similar to FIG. 1 but showing the child already in the bag.
Figure 3:
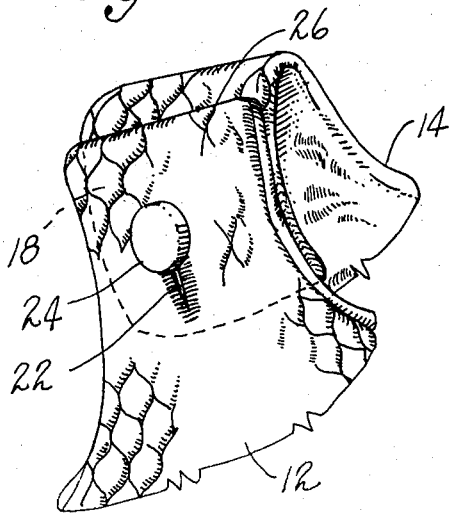
FIG. 3 is a fragmentary detail view on an enlarged scale showing a pair of straps forming a part of the top of the sleeping bag depicted in FIGS. 1 and 2.

The present garment may be made in a variety of materials including blanket fabrics in various weights. One material which has worked well is a quilted multilayered fabric comprising an outer covering of a cotton printed broadcloth. The inner layer may be of a soft cotton blanket and an intermediate layer of wool blanket may be employed for colder environments. In order to provide the necessary warmth and yet leave the child wearer's hands and arms as free as possible from unnecessary restraint, the child is preferably dressed in a sweater to cover his upper torso, a heavy sweater if he is to be exposed to cold weather. In FIG. 1, the child is shown wearing mittens which may also be desirable outdoors in colder climates.

From the foregoing description and illustrations, it is clear that a garment according to the present invention not only provides the warmth, comfort and security needed for infants while sleeping or confined to cribs or playpens, but also that insertion of the child into and withdrawal from the sleeping bag 10 is easily accomplished without imposing any strain on the child. It will also be pointed out that the present specification and drawings will suggest numerous variations within the spirit of the present invention to those of ordinary skill in the art. It is accordinly not intended that the foregoing description be taken as a limitation of the scope of the invention but rather that the breadth of the invention be interpreted in terms of the appended claims.

Having thus disclosed my invention, what I claim as new and desire to secure by Letters Patent of the United States is:

1. A sleeping garment comprising front and rear unitary panels connected by a single seam extending around bottom and side edges of the panels, each panel terminating at its upper end in a pair of unitary shoulder straps, one shoulder strap from each panel being detachably connectible to the strap from the other panel, the upper ends of the panels being contoured together to form a pair of arm holes closed only by the shoulder straps and adapted to leave the upper body of the occupant free of restraint said pair of straps from one of the panels being connected to the pair of straps from the other panel by button and buttonhole connections, the margins of the panels being turned outwardly and the seam being inserted through two thicknesses of each panel.

2. A sleeping garment according to claim 1 further characterized in that a second seam parallel to the first is inserted through the panels outside the outturned edges.

* * * * *